US008221011B2

(12) United States Patent
Yoda

(10) Patent No.: US 8,221,011 B2
(45) Date of Patent: Jul. 17, 2012

(54) RECORDING APPARATUS

(75) Inventor: Seiichiro Yoda, Chiba (JP)

(73) Assignee: Seiko I Infotech Inc. (JP)

( * ) Notice: Subject to any disclaimer, the term of this patent is extended or adjusted under 35 U.S.C. 154(b) by 441 days.

(21) Appl. No.: 12/454,574

(22) Filed: May 19, 2009

(65) Prior Publication Data

US 2009/0290927 A1 Nov. 26, 2009

(30) Foreign Application Priority Data

May 23, 2008 (JP) ..... 2008-135314

(51) Int. Cl.
*B41J 15/00* (2006.01)

(52) U.S. Cl. ..... 400/618

(58) Field of Classification Search ..... 400/618, 400/611, 624
See application file for complete search history.

(56) References Cited

U.S. PATENT DOCUMENTS 6,539,854 B2 * 4/2003 Maeda et al. ..... 101/118
6,641,314 B2 * 11/2003 Mogi ..... 400/120.01
7,102,658 B2 * 9/2006 Sanbongi et al. ..... 347/171
7,249,903 B2 * 7/2007 Shaw, III ..... 400/621

FOREIGN PATENT DOCUMENTS

JP 04031071 A * 2/1992
JP 11320938 A * 11/1999

* cited by examiner

*Primary Examiner* — Seung Lee
(74) *Attorney, Agent, or Firm* — Adams & Wilks

(57) ABSTRACT

To release a medium securely from a fixed roll without damaging the medium. A releasing roller is disposed between a roll and a transport roller for nipping a medium and transporting the medium to a printing position. The releasing roller is rotated by a releasing motor so as to release the medium from the roll in a tangential direction of the roll. In addition, a sag part obtained by sagging the medium is formed between the releasing roller and the transport roller. A tension roller is placed on the sag part so that a constant tension is exerted on the released medium. A sag amount of the sag part is detected by monitoring a lower end part of the sag part with a sensor utilizing infrared rays. A printing apparatus releases the medium by the releasing roller to supply the medium so that the sag amount is within a predetermined range. The medium on which the constant tension is exerted is delivered by the transport roller onto a platen and is printed by a head.

9 Claims, 14 Drawing Sheets

RECORDING APPARATUS

BACKGROUND OF THE INVENTION

The present invention relates to a recording apparatus, and, for example, to a printing apparatus for drawing out a printing medium wound in a roll shape, and for discharging ink onto the printing medium for printing.

For instance, there is known a large ink jet printing apparatus for recording (printing) characters, images, and the like by discharging ink onto a medium such as a plastic sheet material for an advertising drop curtain for a department store, an advertising signboard, or the like.

In the printing apparatus of this type, a roll (roll paper) wound in a roll shape is mounted, and the roll is rotated in a direction of delivering the medium so as to supply the medium to a printing part on a platen.

Incidentally, the roll itself has a weight of, for example, approximately a few tens to a hundred kilograms. Therefore, if the roll is stored horizontally, the medium may be fixed by its weight.

In this case, it is necessary to deliver the fixed part of the roll to the printing part while the medium is delivered. As a printing apparatus having such a mechanism, there is a "paper release mechanism of a printing apparatus" described in Japanese Patent Application Laid-open No. 2007-268824.

This technology uses a releasing nail that is biased onto a surface of the roll so as to be brought into abutment with the firmly fixed part of a medium.

According to this technology, when the roll having the fixed medium is rotated, the fixed part is not delivered but contacts with the releasing nail so that the medium is released.

However, if the releasing nail is used, a tip of the nail scrapes a print surface of the medium before printing and may damage the print surface.

In addition, if the medium is fixed strongly, the releasing nail cannot release the medium. Even if possible, it is necessary to increase a force of pressing the releasing nail to the roll, which may increase a scratch on the surface of the medium.

In addition, it is necessary to change a position of setting the releasing nail in accordance with a direction of winding the roll (inside roll or outside roll), and hence it takes time to set the releasing nail.

SUMMARY OF THE INVENTION

Therefore, it is an object of the present invention to release the medium securely from the fixed roll without damaging the medium.

In order to achieve the above-mentioned object, the present invention provides a recording apparatus, including: roll mounting means for mounting a roll wound with a recording medium; transport means for transporting the recording medium with a transport roller in accordance with a recording operation; recording means for performing recording on the transported recording medium; and releasing means disposed between the roll mounting means and the transport roller, for pulling the recording medium from the mounted roll by rotation of the releasing roller so that the recording medium is released from the roll.

Further, the present invention provides a recording apparatus having sag amount detecting means for detecting a sag amount of a sag part of the recording medium, the sag part being formed by placing a tension roller for exerting a predetermined tension on the recording medium between the releasing roller and the transport roller, in which the releasing means adjusts a releasing amount of the recording medium in accordance with the detected sag amount.

Further, the present invention provides the recording apparatus, in which the sag amount detecting means detects a position of the tension roller based on whether or not light extending from a light emitting part to a light receiving part is interrupted by the sag part.

According to the present invention, the fixed medium is released by the releasing roller, so that the medium can be released securely without damaging the medium.

DETAILED DESCRIPTION OF THE PRESENT INVENTION

(1) General Outline of an Embodiment

Figure 1:
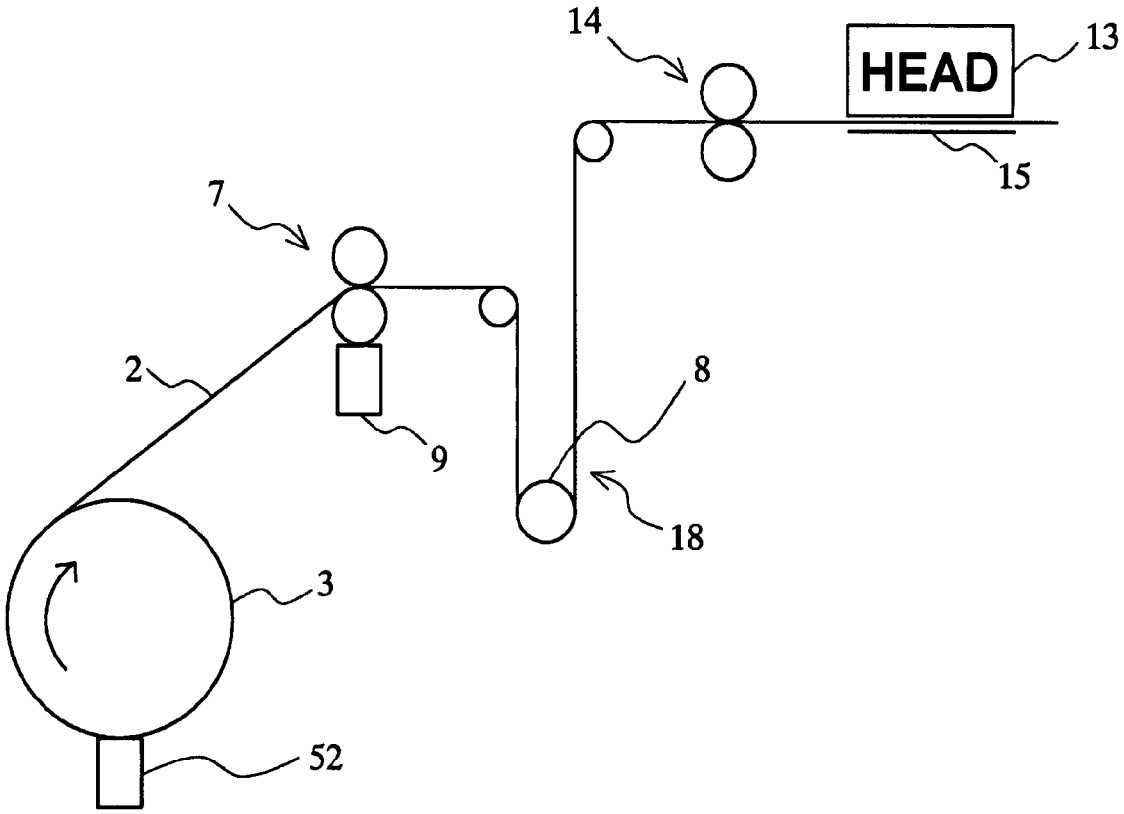
FIG. 1 is a diagram for describing a general outline of a printing apparatus according to this embodiment.

FIG. 1 is a diagram for illustrating a general outline of a printing apparatus according to this embodiment.

A releasing roller 7 is disposed between a roll 3 and a transport roller 14 for nipping and transporting a medium 2 to a printing position. The releasing roller 7 is rotated by a releasing motor 9 so as to take the medium off the roll 3 in a tangential direction of the roll 3. It is possible to rotate the roll 3 by a roll rotating motor 52, if necessary.

In addition, the medium 2 is sagged to form a sag part 18 between the releasing roller 7 and the transport roller 14. A tension roller 8 is placed on the sag part 18, whereby a constant tension is exerted on the released medium 2.

A sag amount in the sag part 18 is detected by monitoring a lower end part of the sag part 18 with a sensor utilizing infrared rays. The printing apparatus releases the medium 2 by the releasing roller 7 to supply the same so that the sag amount is within a predetermined range.

The medium 2 on which a constant tension is exerted by the tension roller 8 is delivered by the transport roller 14 onto the platen 15, and then a head 13 can print thereon.

The transport roller 14 can transport the medium 2 stably because of the constant tension exerted on the medium 2, whereby the head 13 can print stably.

In this way, according to this embodiment, it is possible to provide a printing apparatus having a transport mechanism for releasing and transporting the medium 2 while taking the same off the roll 3 that is hard to release therefrom.

(2) Detail of the Embodiment

Figure 2:
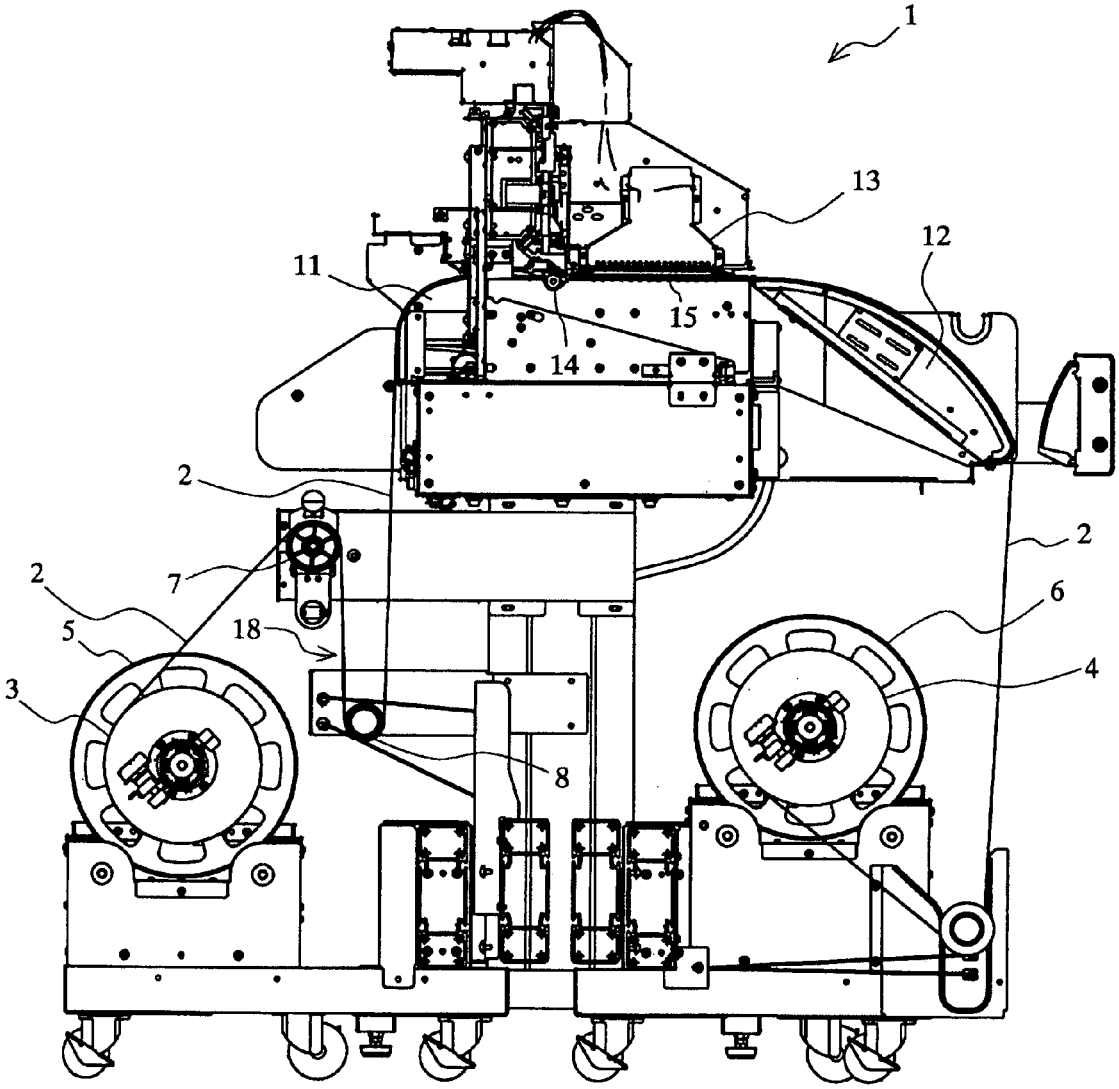
FIG. 2 is a diagram illustrating a side of the printing apparatus according to this embodiment.

FIG. 2 is a diagram illustrating a side view of the printing apparatus 1 according to this embodiment.

The roll 3 (roll medium) is disposed in the printing apparatus 1 so that the axis of the roll 3 is parallel to Y direction (that is perpendicular to the paper surface).

The roll 3 is mounted to a scroller shaft of the scroller 5 so that the roll 3 can rotate freely together with the scroller 5.

In addition, the printing apparatus 1 can also rotate the scroller 5 by a roll rotating motor (not shown) so that the roll 3 is rotated in a delivering direction or in a rewinding direction.

The medium 2 delivered from the roll 3 is led onto the platen 15 via the releasing roller 7, the tension roller 8, a rear medium guide 11, and the transport roller 14.

Over the platen 15, the head 13 can move in the Y direction along a rail-like guide called a Y rail, and the head 13 discharges ink from a nozzle in the lower end surface onto the medium while moving on the Y rail.

The medium 2 printed by the head 13 is rolled up by a roll 4 via a front medium guide 12.

The front medium guide 12 incorporates a heater, and the heat of the heater dries the ink discharged onto the medium 2.

The roll 4 is mounted to a scroller shaft of the scroller 6, and the printing apparatus 1 rotates the scroller 6 by a motor so that the medium 2 after the printing process is rolled up by the roll 4.

The printing apparatus 1 has an operation panel disposed on the side of the front medium guide 12, and a user can operate the printing apparatus 1 standing in front of the operation panel.

Therefore, with respect to the printing apparatus 1, the side of the front medium guide 12 (right hand side of FIG. 2) is referred to as a front side while the side of the rear medium guide 11 (left hand side of FIG. 2) is referred to as a rear side in the following description.

In addition, the side on which the head 13 is disposed (upward side of FIG. 2) is referred to as an upper side while the side on which the roll 3 and the roll 4 are disposed (downward side of FIG. 2) is referred to as a lower side.

The printing apparatus 1 described above works as a recording apparatus for performing a recording process by applying ink onto the surface of the medium.

Figure 3:
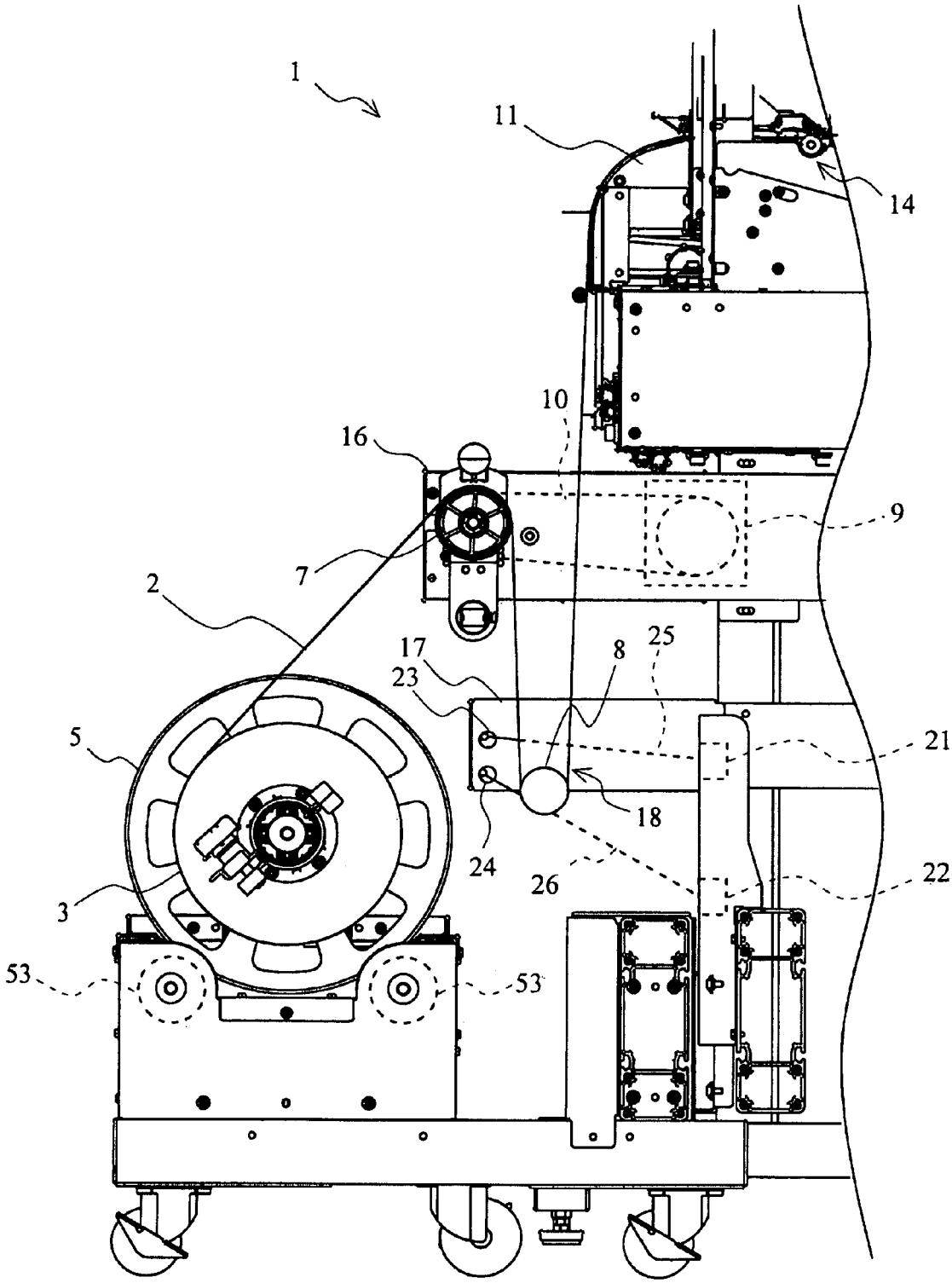
FIG. 3 is a diagram illustrating a side of a rear part of the printing apparatus in detail.

FIG. 3 is a diagram illustrating a side view of a rear part of the printing apparatus 1 in detail.

The scroller 5 is constituted of a disc shape member and a scroller shaft as a center shaft of the disc shape member. The scroller shaft is inserted in an air core part provided in the center of the roll 3 so that the roll 3 is mounted to the scroller 5.

There are two types of the roll 3 including an outside roll medium and an inside roll medium, and FIG. 3 illustrates a case of the outside roll medium. The outside roll and the inside roll of the medium 2 are described later in detail.

In this way, the printing apparatus 1 has a roll mounting means for mounting the roll (roll 3) on which the recording medium (medium 2) is rolled by using the scroller 5.

Two rollers 53 having rotation shafts parallel to the scroller shaft are disposed on the lower side of the scroller 5 in the front and the back thereof with a space therebetween.

Outer peripheries of the rollers 53 contact with an outer rim of the disc shape member of the scroller 5. The printing apparatus 1 rotates the roller 53 by the roll rotating motor (not shown) so that the scroller 5 and the roll 3 mounted on the scroller 5 can be rotated about the scroller shaft.

The rotation of the roller 53 can be controlled by a lever switch (not shown) operated by the user.

The user operates the lever switch so as to rotate the roll 3 in a desired direction for setting the medium 2 to the printing apparatus 1 or rewinding the medium 2.

In addition, the lever switch can also be used for disconnecting the drive of the roller 53. In this case, the scroller 5 and the roll 3 rotate freely.

Note that the rotation of the roll 3 is set to be the in a free rotation state while the printing apparatus 1 is printing the medium 2, because the releasing roller 7 releases and pulls the medium 2 from the roll 3 so as to supply the same.

However, it is possible to adopt another structure in which the roll 3 is rotated by the roller 53 in synchronization with the releasing roller 7.

The releasing roller 7 is disposed on the upper and front side of the roll 3 so that its rotation shaft is parallel to a rotation shaft of the roll 3. Sufficient height of the releasing roller 7 is secured for the sag of the medium 2, and the sag does not interrupt with the roll 3 and the like.

A circumferential surface of the releasing roller 7 is covered with a slip resistant material, such as rubber, and has an intimate contact with the medium 2 so as not to slip.

The releasing roller 7 is attached to a distal end side of a releasing roller support member 16 extending toward the rear side of the printing apparatus 1, and the releasing motor 9 is attached to a proximal end side of the releasing roller support member 16 on the depth side of FIG. 3.

A belt 10 is set between the releasing motor 9 and the releasing roller support member 16. A torque of the releasing motor 9 is transmitted via the belt 10 to the releasing roller 7, whereby the releasing roller 7 is rotated.

The medium 2 is drawn out from roll 3 and runs on the upper side of the circumferential surface of the releasing roller 7. When the releasing roller 7 is rotated in the delivering direction of the medium 2, the medium 2 is pulled by the rotation of the releasing roller 7 so as to be released from the roll 3 in a tangential direction thereof.

A driving force of the releasing motor 9 and a friction force between the circumferential surface of the releasing roller 7 and the medium 2 are set to be sufficiently endurable for releasing the fixed medium 2.

Note that the releasing roller 7 can also be constituted of pinch rollers for pinching the medium 2 from both upper and lower sides.

The tension roller 8 is constituted of a pipe-like roller made of aluminum or other material, for example. Otherwise, the tension roller 8 can be constituted of a cylindrical rod material.

Between the releasing roller 7 and the rear medium guide 11, the medium 2 is sagged to form the sag part 18 (sag buffer), and the tension roller 8 is placed on the sag part 18.

A position of the tension roller 8 moves up and down in accordance with a change in the sag amount, but the tension roller 8 can exert a constant tension on the medium 2 because the tension roller 8 is simply placed on the sag part 18 of the medium 2.

Note that, in the strict sense, the tension varies because of inertia of the tension roller 8 when the tension roller 8 moves up and down, but the variation is so small to be negligible for the transport roller 14 to supply the medium 2 stably.

In addition, the tension roller 8 may be a swinging tension bar (that presses the medium 2 downward with weight of the bar attached to a tip of an arm), for example. In this case, the tension bar attached to the tip of the arm rotates about a certain supporting point, and hence inertia of the arm is added to the bar so that the tension may vary in accordance with a position of the bar. Therefore, compared with the tension bar with the arm, the tension roller 8 that is simply placed can provide a desirable transportation accuracy.

In addition, it is possible to adopt another structure of the tension bar in which bars are disposed at the front and the back of the rotation center. In this case, inertia moment of the tension bar itself is apt to be larger compared with the tension to be exerted on the medium 2. Then, a tension variation at the start and the stop timings may increase so as to adversely affect the transportation accuracy.

However, it is possible to mount a swinging tension bar or a tension bar in which bars are disposed at the front and the back of the rotation center by using sufficiently light material to form the arm.

On the rear side of the tension roller 8, an upper light emission source 23 and a lower light emission source 24 are provided to an overhang member 17.

The upper light emission source 23 is disposed on the upper side of the lower light emission source 24. The upper light emission source 23 and the lower light emission source 24 each emit infrared beams toward substantially the front in a slanting downward direction.

On the other hand, on the front side of the tension roller 8, two light receiving sensors including an upper sensor 21 and a lower sensor 22 for detecting the infrared beams from the upper light emission source 23 and the lower light emission source 24, respectively.

The upper sensor 21 is disposed on the upper side of the lower sensor 22, and a distance between the upper sensor 21 and the lower sensor 22 is set to be larger than a distance between the upper light emission source 23 and the lower light emission source 24.

Further, the upper sensor 21 detects an infrared beam 25 emitted from the upper light emission source 23 toward the front in a slightly slanting downward direction, and the lower sensor 22 detects an infrared beam 26 emitted from the lower light emission source 24 toward the front in a slanting downward direction.

Optical paths of the infrared beam 25 emitted from the upper light emission source 23 to the upper sensor 21 and the infrared beam 26 emitted from the lower light emission source 24 to the lower sensor 22 are set to be on the same plane perpendicular to the rotation axis of the tension roller 8 and to be at positions interrupted by the plane formed by the medium 2.

Therefore, if the lower end part of the sag part 18 of the medium 2 is above the infrared beam 25, both the upper sensor 21 and the lower sensor 22 detect the infrared beams. If the lower end part thereof is above the infrared beam 26 and below the infrared beam 25, only the lower sensor 22 detects the infrared beam. If the lower end part thereof is below the infrared beam 26, none of the upper sensor 21 and the lower sensor 22 detects the infrared beam.

The printing apparatus 1 detects the sag amount of the medium 2, i.e., a position of the tension roller 8 in this way and drives the releasing roller 7 in accordance with the detected result, whereby the releasing amount of the medium 2 is adjusted.

Various methods of adjusting the releasing amount are possible. For instance, the printing apparatus 1 drives the releasing motor 9 at a constant speed for a given period when the lower sensor 22 detects the infrared beam 26, and then stops the releasing motor 9.

More specifically, the tension roller 8 moves upward so that the sag amount decreases when the medium 2 is consumed in the printing. When the lower end part of the sag part becomes above the infrared beam 26, the printing apparatus 1 detects this by the lower sensor 22 and drives the releasing roller 7 so that a constant amount of medium 2 is released and supplied from the roll 3.

In addition, when the medium 2 of the roll 3 is consumed completely, the sag amount decreases because the medium 2 is not supplied from the roll 3 despite that the medium 2 is consumed in the printing. Then, the lower end part becomes above the infrared beam 25 so that the upper sensor 21 detects the infrared beam.

Thus, the printing apparatus 1 detects that the medium has run out, stops the printing operation, and alarms the user.

Note that the maximum value of the releasing force of the releasing roller 7 is approximately a value required for releasing fixation of the medium 2 (for example, 8 kg). If a force larger than the maximum value is necessary, the releasing roller 7 does not rotate. Therefore, if the medium runs out, the lower end part of the sag part 18 moved upward without tearing off the medium 2 from the roll 3 or breaking the scroller 5.

In this way, the printing apparatus 1 includes the sag amount detecting means for detecting the sag amount of the sag part (sag part 18) of the recording medium formed by placing the tension roller (tension roller 8) for exerting a predetermined tension on the recording medium (medium 2) between the releasing roller (releasing roller 7) and the transport roller (transport roller 14), and adjusts the releasing amount of the recording medium in accordance with the detected sag amount.

In addition, the sag amount detecting means detects a position of the tension roller (tension roller 8) in accordance with whether or not the light beams (infrared beam 25 and infrared beam 26) extending from the light emitting parts (upper light emission source 23 and lower light emission source 24) to the light receiving parts (upper sensor 21 and lower sensor 22) are interrupted by the sag part 18.

The rear medium guide 11 is a guide plate having a substantially cylindrical surface formed around the axis parallel to the center axis of the roll 3, and guides the medium 2 transported from the tension roller 8 substantially upward and vertically so as to be transported in a horizontal direction.

The transport roller 14 is disposed in front of the rear medium guide 11 and is formed of pinch rollers sandwiching the medium 2 vertically.

The transport roller 14 transports the medium 2 to the lower position of the head 13 in synchronization with the printing operation of the head 13 (see FIG. 2).

A stable and appropriate tension is exerted on the medium 2 that is supplied from the rear medium guide 11 to the transport roller 14 by the tension roller 8, whereby the transport roller 14 can transport the medium 2 stably.

In this way, the printing apparatus 1 includes transporting means for transporting the recording medium (medium 2) by the transport roller in accordance with the recording operation (printing operation), and the head 13 works as recording means for recording (printing) on the transported recording medium.

In addition, the printing apparatus 1 includes releasing means disposed between the roll mounting means (scroller 5 or the like) and the transport roller (transport roller 14) for pulling the recording medium (medium 2) from the mounted roll (roll 3) by the rotation of the releasing roller (releasing roller 7) to release the recording medium from the roll.

Incidentally, the roll 3 is classified into an outside roll medium in which the outer circumferential surface of the medium 2 is the print surface and an inside roll medium in which the inner circumferential surface of the medium 2 is the print surface. The method of mounting the roll 3 to the printing apparatus 1 is different depending on whether the roll 3 is the outside roll or the inside roll. Hereinafter, the mounting methods for the roll 3 are described.

Figure 4A:
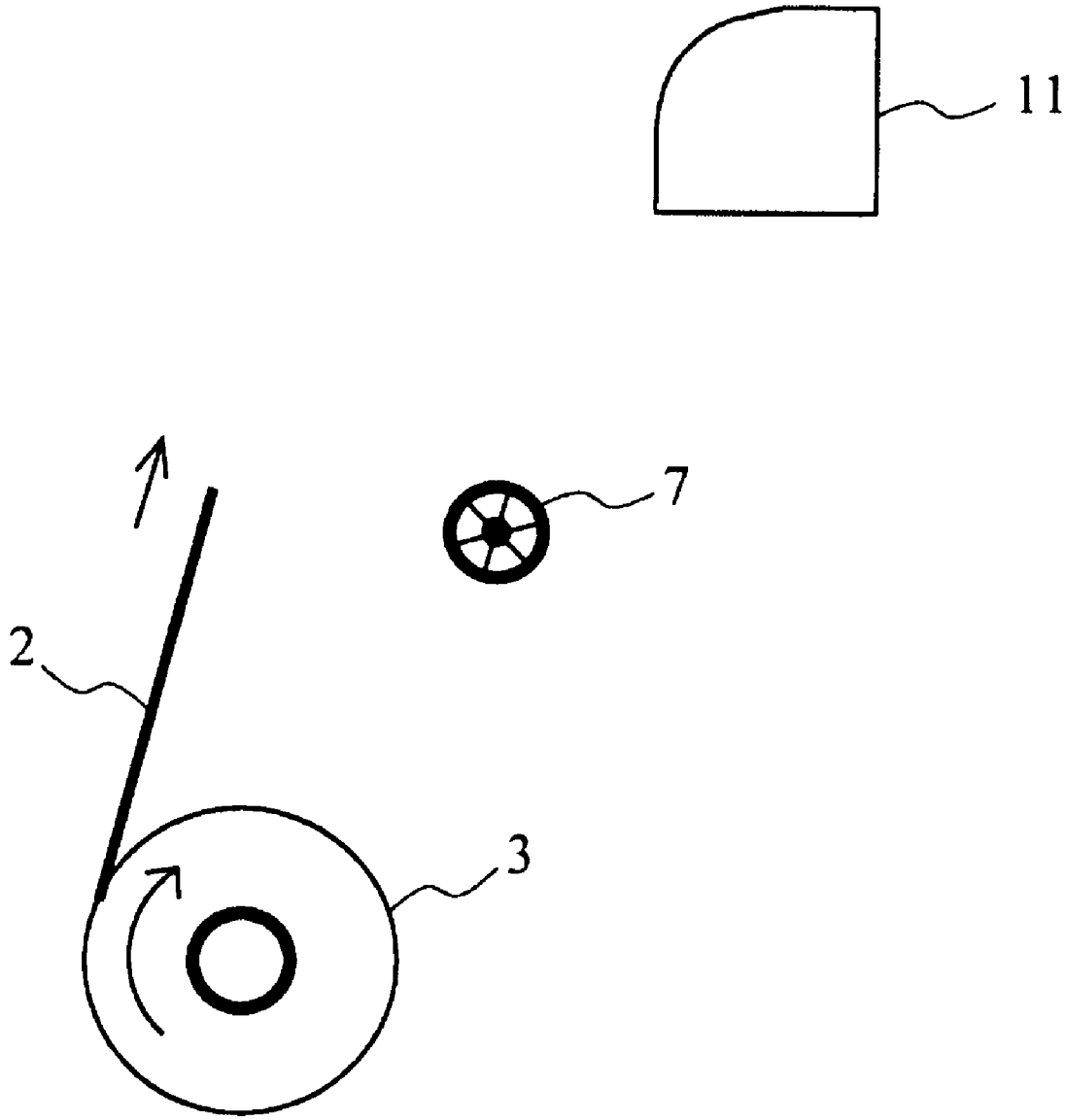
FIG. 4A and FIG. 4B are diagrams for describing a method of mounting a roll of an outside roll medium.

FIG. 4A illustrates a state where the roll 3 of the outside roll medium is mounted to the scroller 5 (not shown).

In this case, the medium 2 is drawn out from the rear end of the roll 3 in the delivering direction as indicated by the arrow line.

Figure 4B:
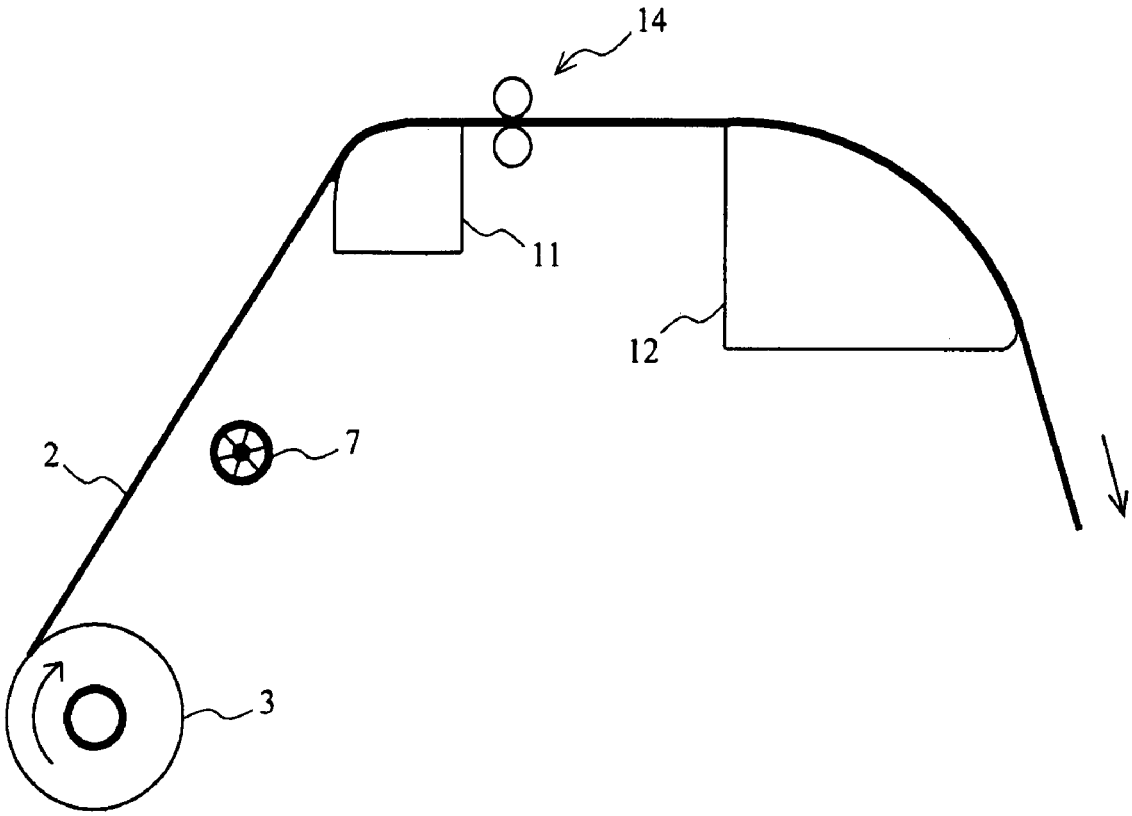

Next, as illustrated in FIG. 4B, the medium 2 is passed to the rear medium guide 11 above the releasing roller 7. The medium 2 is sandwiched by the transport roller 14 and is further passed to the front medium guide 12, and then is wound around the scroller 6 as illustrated in FIG. 2.

Figure 5A:
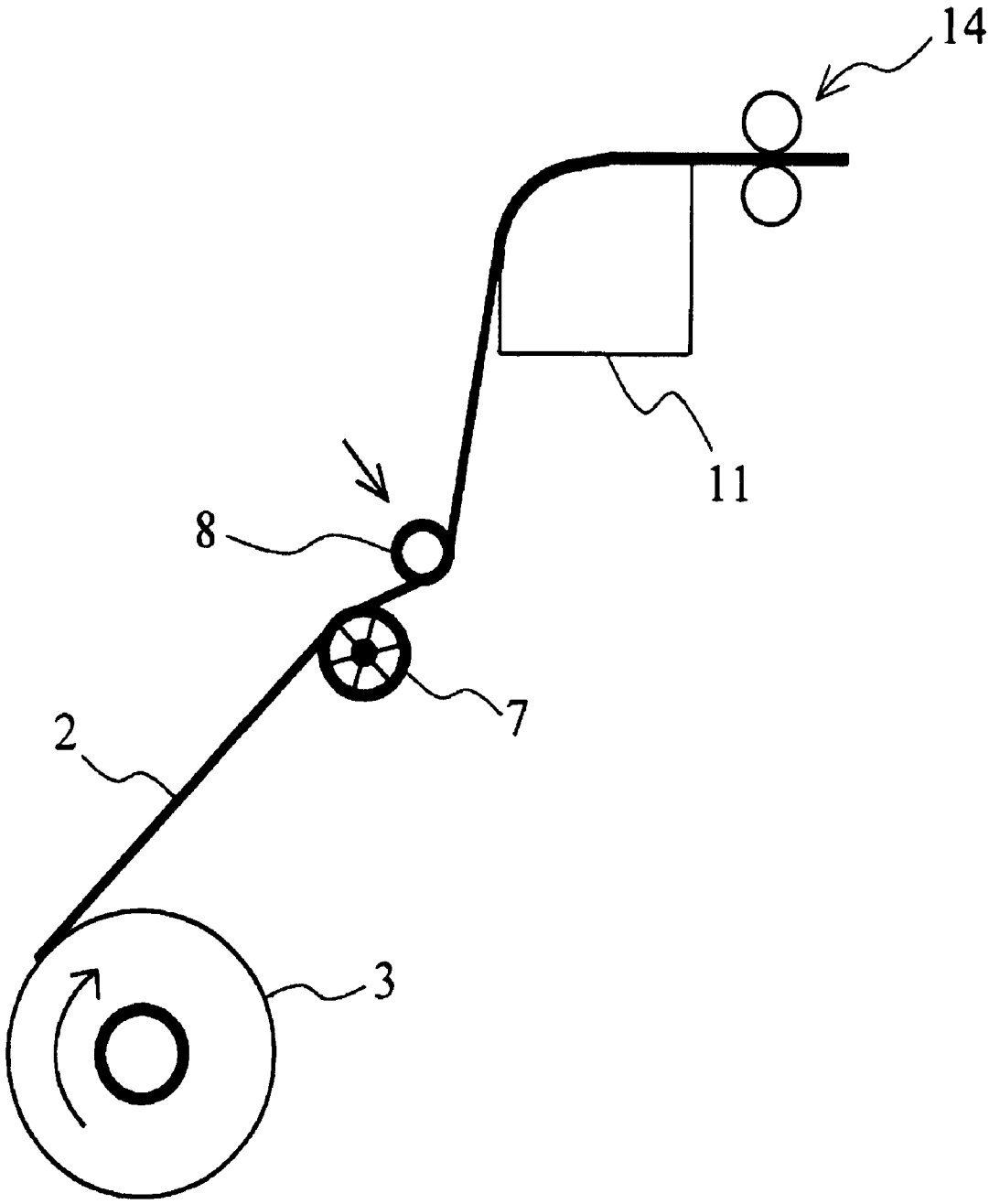
FIG. 5A and FIG. 5B are diagrams for describing the method of mounting the roll of the outside roll medium.

Next, as illustrated in FIG. 5A, the roll 3 is rotated in the delivering direction as indicated by the arrow line. The medium 2 is sagged between the releasing roller 7 and the rear medium guide 11, and the tension roller 8 is placed on the sag part.

Figure 5B:
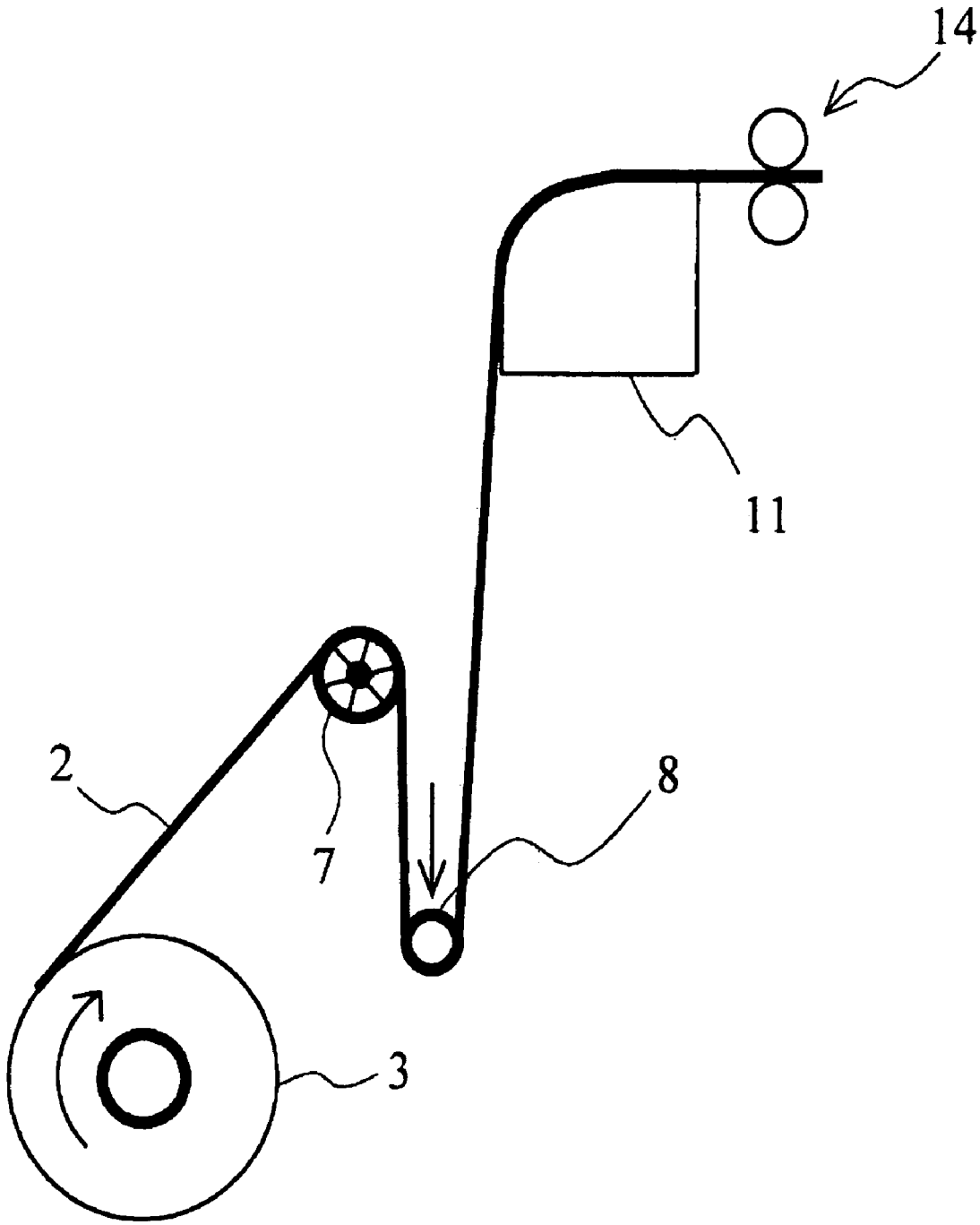

Further, as illustrated in FIG. 5B, the roll 3 is further rotated in the delivering direction to further sag the medium 2 so that the lower end part of the sag part is positioned at a predetermined position detected by the upper sensor 21 and the lower sensor 22.

In this way, the outside roll medium is mounted to the printing apparatus 1.

Figure 6A:
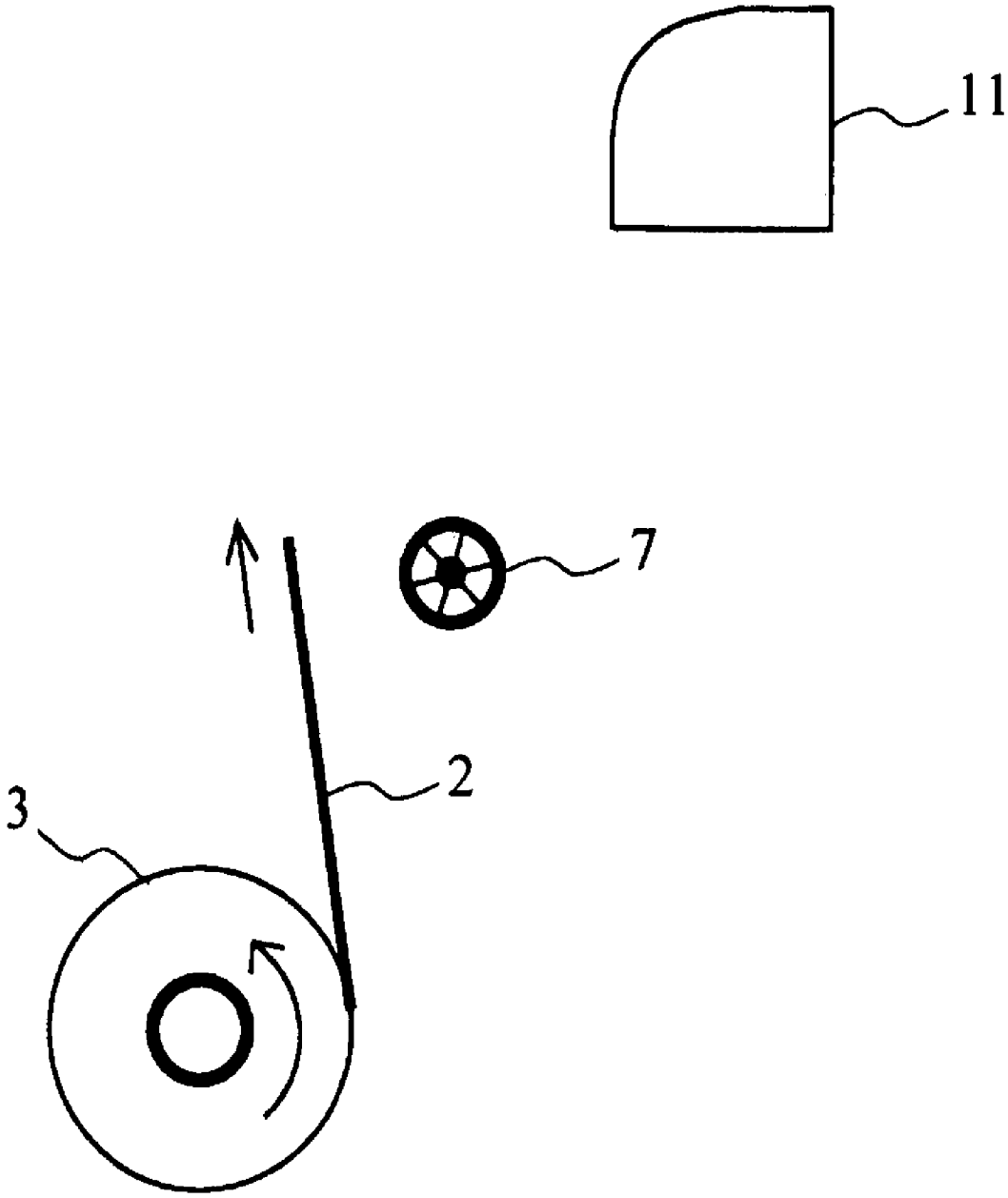
FIG. 6A and FIG. 6B are diagrams for describing a method of mounting a roll of an inside roll medium.

FIG. 6A illustrates a state where the roll 3 of the inside roll medium is mounted to the scroller 5 (not shown).

In this case, the medium 2 is drawn out from the front end of the roll 3 in the delivering direction as indicated by the arrow line. Note that the delivering direction is opposite between the outside roll medium and the inside roll medium.

Figure 6B:
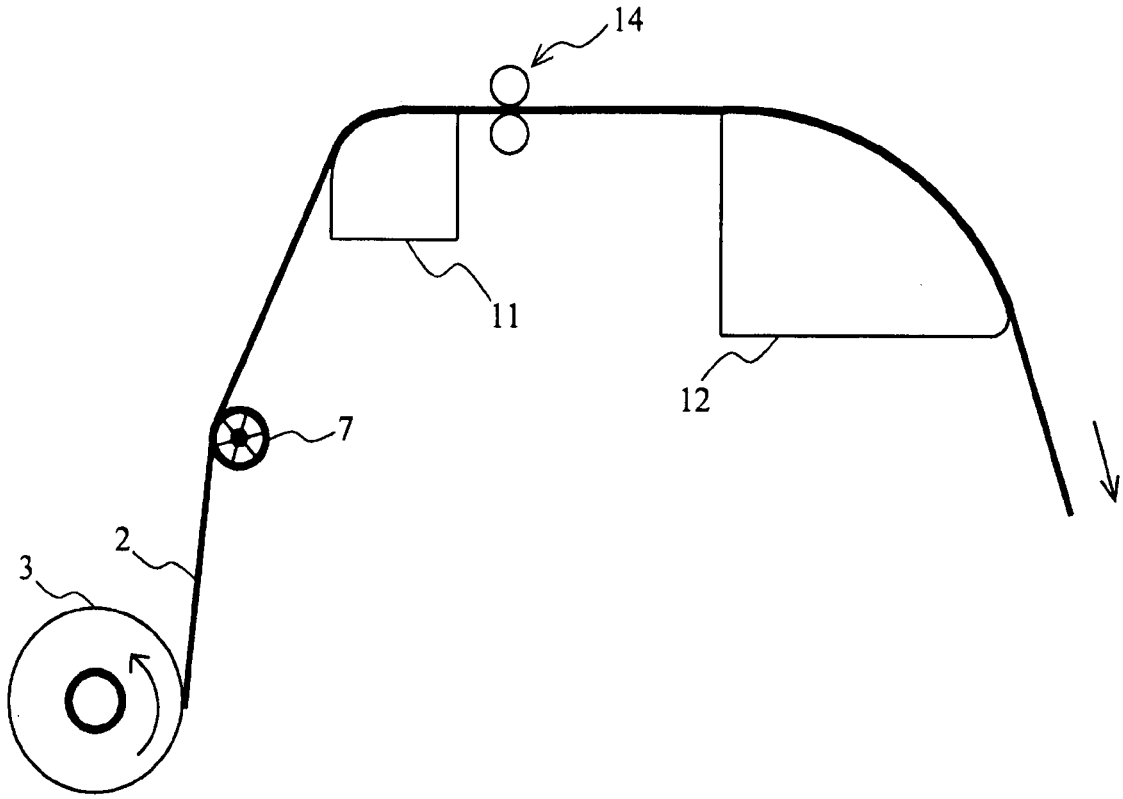

Next, as illustrated in FIG. 6B, the medium 2 is passed to the rear medium guide 11 over the releasing roller 7. The medium 2 is sandwiched by the transport roller 14 and is further passed to the front medium guide 12, and then is wound around the scroller 6 as illustrated in FIG. 2.

Figure 7A:
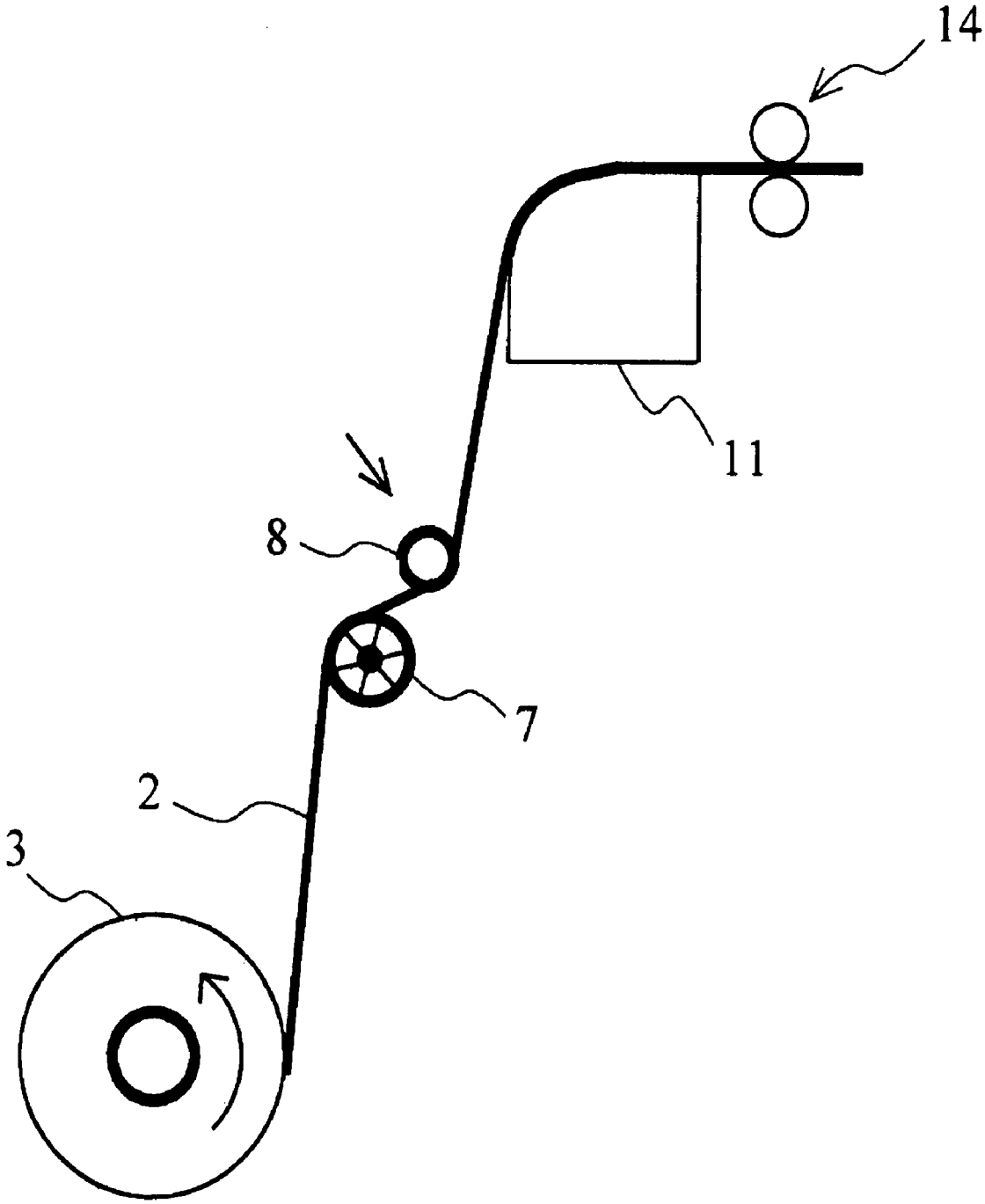
FIG. 7A and FIG. 7B are diagrams for illustrating the method of mounting the roll of the inside roll medium.

Next, as illustrated in FIG. 7A, the roll 3 is rotated in the delivering direction as indicated by the arrow line. The medium 2 is sagged between the releasing roller 7 and the rear medium guide 11, and the tension roller 8 is placed on the sag part.

Figure 7B:
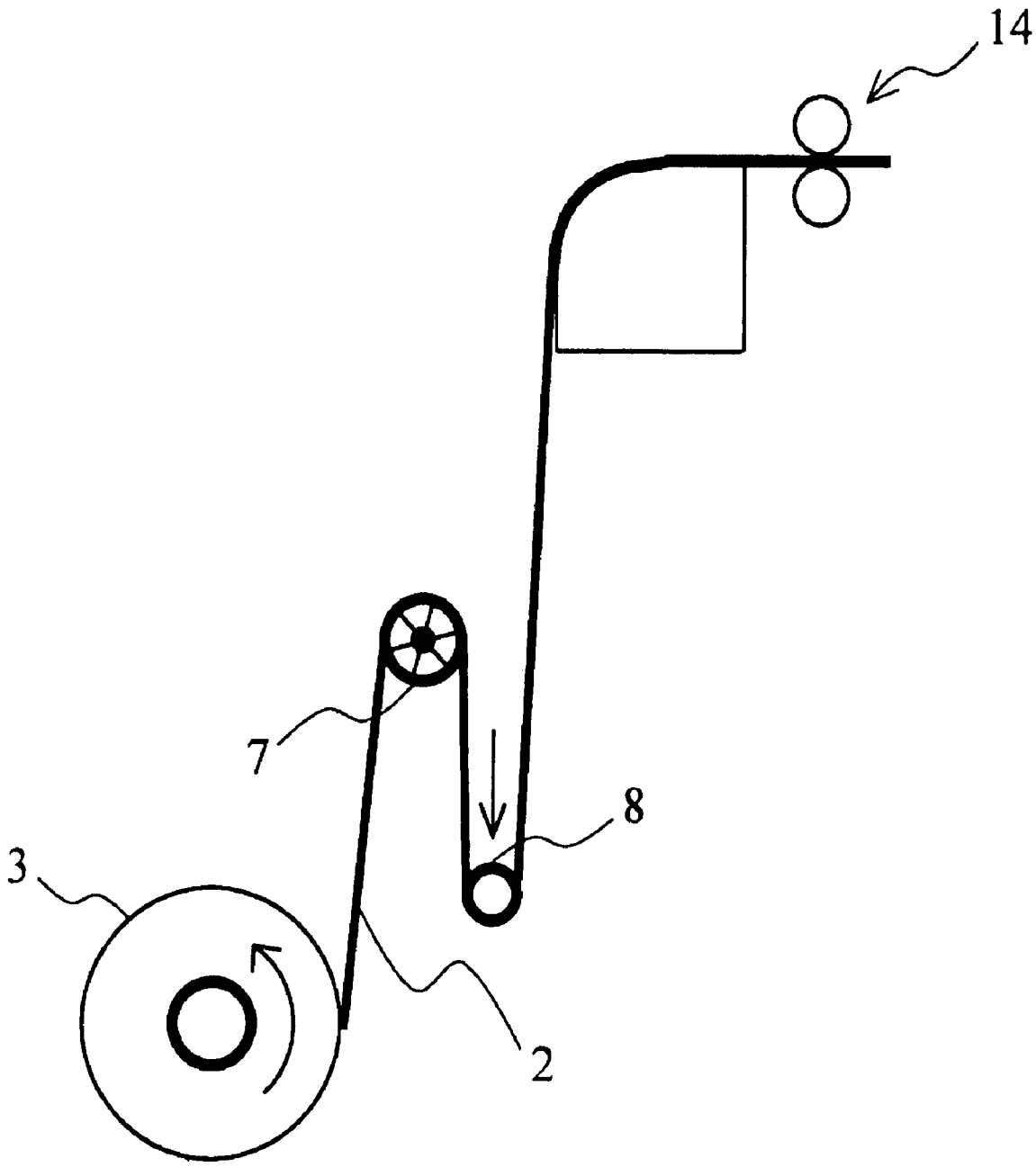

Further, as illustrated in FIG. 7B, the roll 3 is further rotated in the delivering direction to further sag the medium 2 so that the lower end part of the sag part is positioned at a predetermined position detected by the upper sensor 21 and the lower sensor 22.

In this way, the inside roll medium is mounted to the printing apparatus 1.

Figure 8:
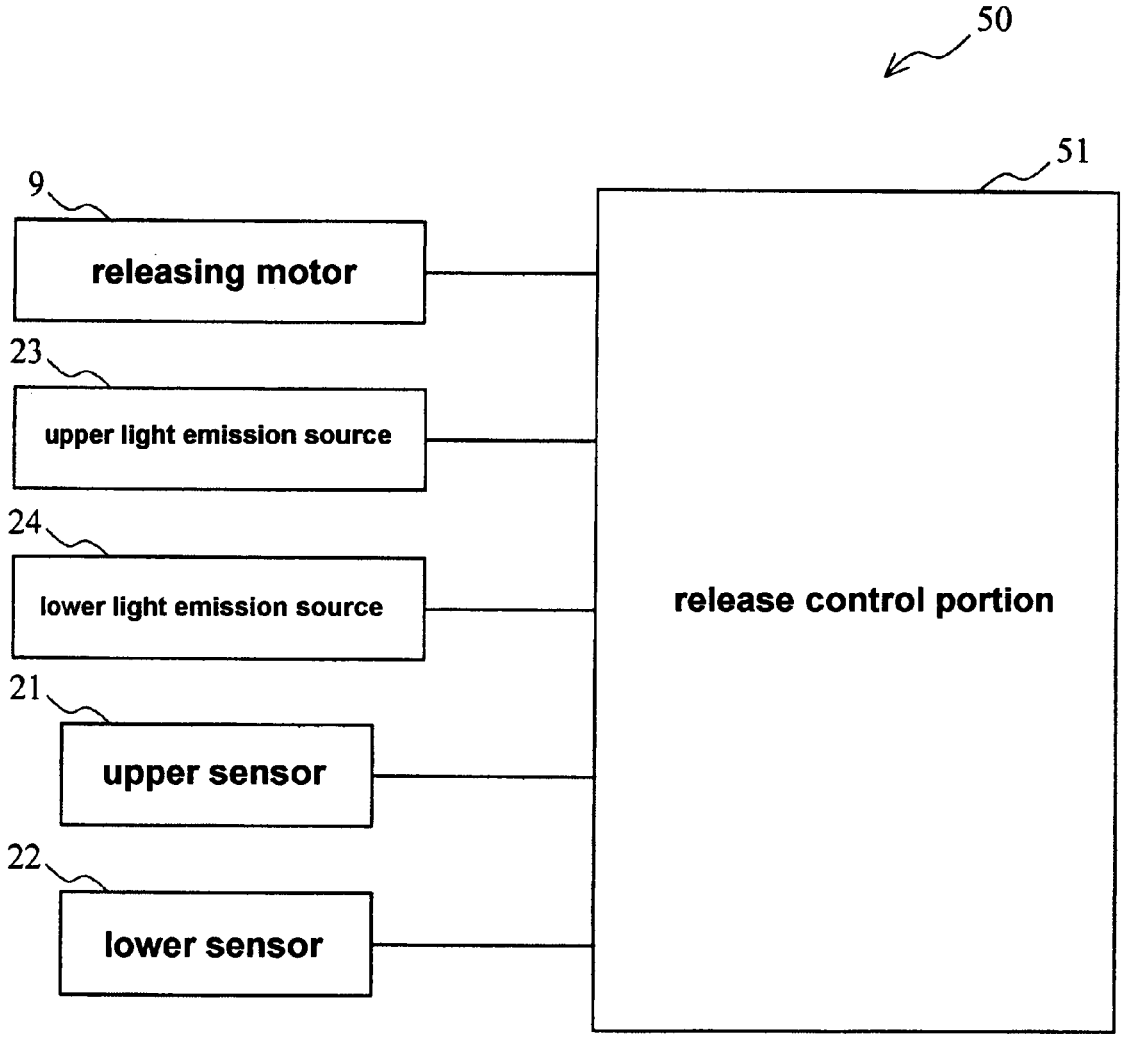
FIG. 8 is a block diagram illustrating a releasing roller control system of the printing apparatus.

FIG. 8 is a block diagram illustrating the releasing roller control system 50 of the printing apparatus 1.

The releasing roller control system 50 works as a releasing device for releasing the medium 2 from the roll 3.

The releasing roller control system 50 is formed of a release control portion 51, the releasing motor 9, the upper light emission source 23, the lower light emission source 24, the upper sensor 21, the lower sensor 22, and the like.

The release control portion 51 drives the upper light emission source 23 and the lower light emission source 24 so as to emit the infrared beams and monitors whether or not the upper sensor 21 and the lower sensor 22 detect the infrared beams. The release control portion 51 decides whether or not the releasing of the medium 2 is necessary in accordance with a result of the detection.

If it is decided that the releasing operation is necessary, the release control portion 51 drives the releasing motor 9 so as to release the medium 2 from the roll 3.

Figure 9:
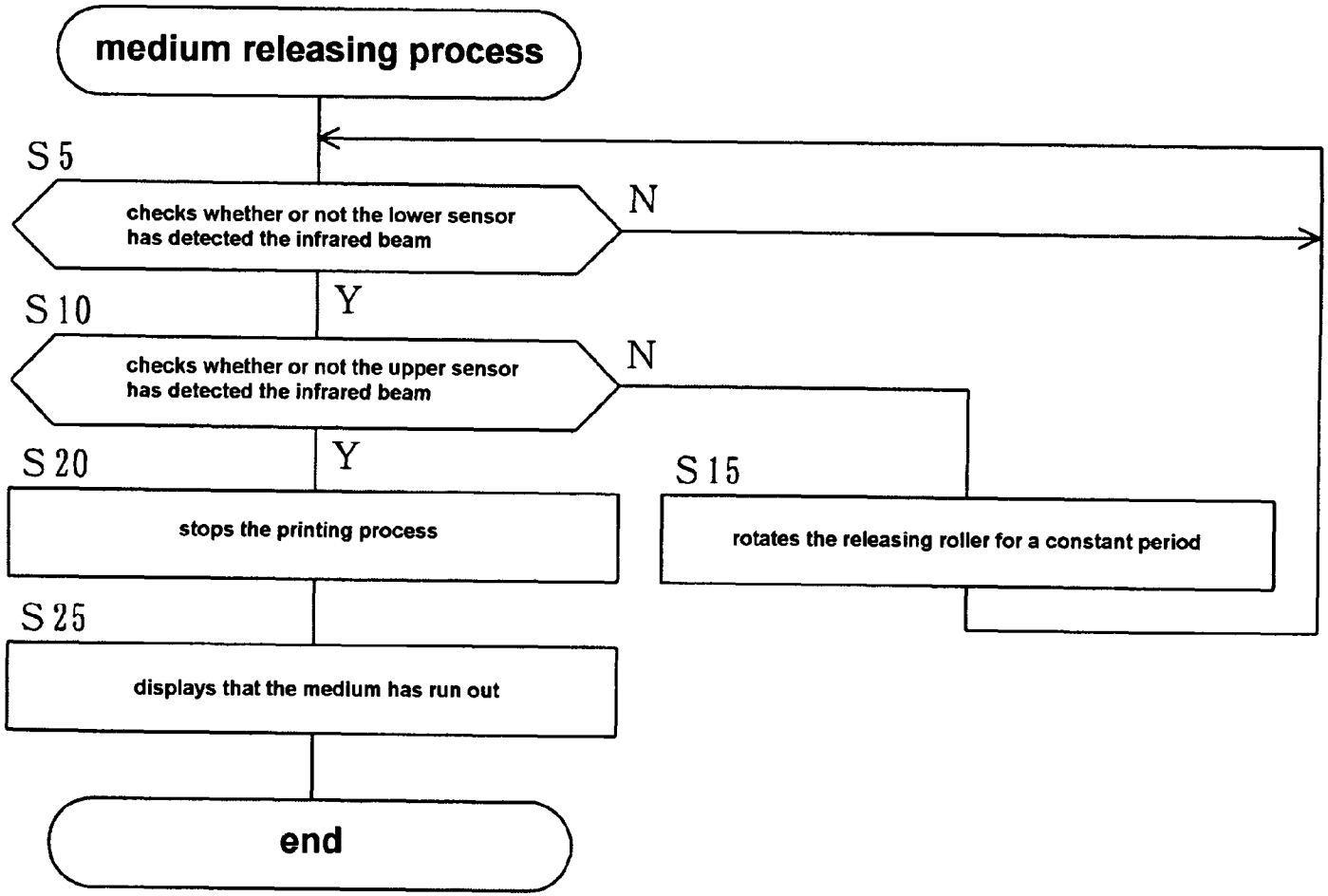
FIG. 9 is a flowchart for describing a procedure of a medium releasing process.

FIG. 9 is a flowchart for describing a procedure of the medium releasing process performed by the releasing roller control system 50.

First, the releasing roller control system 50 causes the upper light emission source 23 and the lower light emission source 24 to emit light, and monitors detection values of the upper sensor 21 and the lower sensor 22.

Next, the releasing roller control system 50 checks whether or not the lower sensor 22 has detected the infrared beam 26 (Step 5).

If the lower sensor 22 has not detected the infrared beam 26 (N in Step 5), the medium 2 is sagged to a necessary extent. Therefore, the releasing roller control system 50 does not particularly drive the releasing roller 7 but continues checking in Step 5.

If the lower sensor 22 has detected the infrared beam 26 (Y in Step 5), the releasing roller control system 50 further checks whether or not the upper sensor 21 has detected the infrared beam 25 (Step 10).

If the upper sensor 21 has detected the infrared beam 25 (Y in Step 10), it means that the medium has run out. Therefore, the releasing roller control system 50 stops the printing process (Step 20) and displays that the medium has run out (Step 25).

On the contrary, if the upper sensor 21 has not detected the infrared beam 25 (N in Step 10), the releasing roller control system 50 rotates the releasing roller 7 for a given period (Step 15) so as to release the medium 2 from the roll 3 by a given amount and delivers the medium 2.

After that, the releasing roller control system 50 goes back to Step 5 and monitors an output of the lower sensor 22.

Through the process described above, the releasing roller control system 50 rotates the releasing roller 7 when the sag amount of the medium 2 decreases to be smaller than a necessary amount, so as to control the sag amount of the medium 2 to be a value within a predetermined range.

In addition, the releasing roller control system 50 can detect that the medium has run out and issue the alarm.

Figure 10:
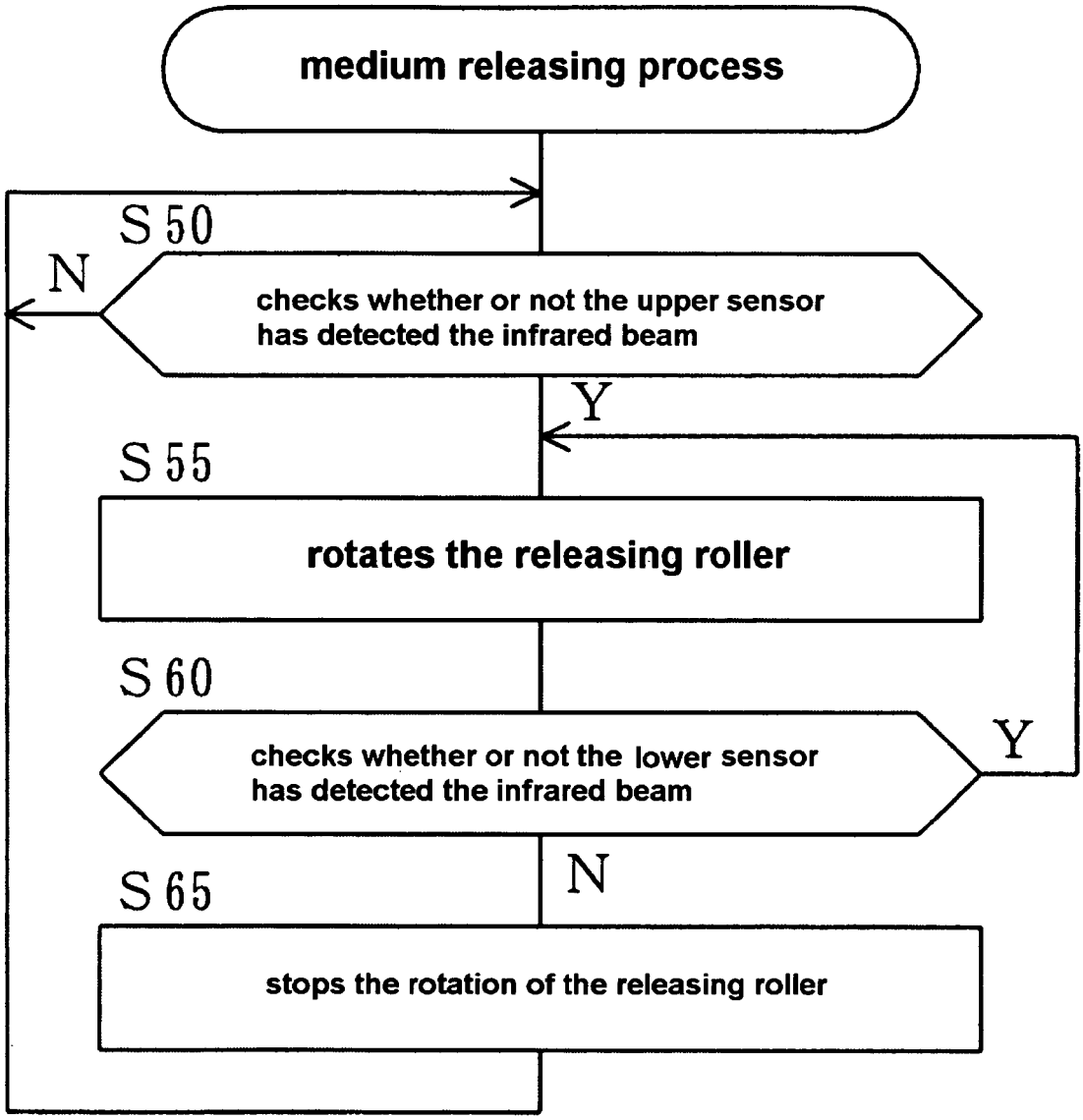
FIG. 10 is a flowchart for describing a modification of the procedure of the medium releasing process.

FIG. 10 is a flowchart for describing a modification of the medium releasing process performed by the releasing roller control system 50.

In this modification, the releasing roller control system 50 controls so that the lower end part of the sag part 18 is located between the infrared beam 25 and the infrared beam 26.

First, the releasing roller control system 50 checks whether or not the upper sensor 21 has detected the infrared beam 25 (Step 50).

If the upper sensor 21 has not detected the infrared beam 25 (N in Step 50), the releasing roller control system 50 continuously monitors the upper sensor 21 in Step 50.

If the upper sensor 21 detects the infrared beam 25 (Y in Step 50), it means that the lower end part of the sag part 18 has moved upward. Therefore, the releasing roller control system 50 rotates the releasing roller 7 so as to release the medium 2 from the roll 3 (Step 55).

Further, the releasing roller control system 50 monitors the lower sensor 22 while maintaining the rotation of the releasing roller 7. If the lower sensor 22 detects the infrared beam 26 (N in Step 60), it means that the lower end part of the sag part 18 has not reached the infrared beam 26 yet. Therefore, the control goes back to Step 55 to continue the rotation of the releasing roller 7.

On the contrary, if the lower sensor 22 does not detect the infrared beam 26 (Y in Step 60), it means that the lower end part of the sag part 18 has moved downward and interrupted the infrared beam 26. Therefore, the releasing roller control system 50 stops the releasing roller 7 (Step 65) and goes back to Step 50.

The following effects can be attained by this embodiment described above.

(1) The medium 2 is released by the releasing roller 7, and hence it is possible to release the medium 2 by a strong force without damaging the print surface of the medium 2 even in a case of the roll 3 fixed tightly.

(2) The tension roller 8 is placed on the sag part 18 by sagging the medium 2 between the releasing roller 7 and the transport roller 14, and hence tension of the medium 2 at a position immediately before the transport roller 14 can be maintained to be constant so that high transportation accuracy can be obtained.

(3) The infrared beam is used for detecting the sag amount, and hence a mechanical system is not necessary. Therefore, it is possible to reduce the failure rate, facilitate the maintenance, and reduce the cost.

(4) The tension roller 8 does not need a supporting mechanism, and hence both the inside roll medium and the outside roll medium do not require any particular setting. In addition, manufacturing cost can be reduced.

What is claimed is:

1. A recording apparatus, comprising:

roll mounting means for mounting a roll wound with a recording medium;

transport means for transporting the recording medium with a transport roller in accordance with a recording operation;

recording means for performing recording on the transported recording medium;

releasing means disposed between the roll mounting means and the transport roller for pulling the recording medium from the mounted roll by rotation of a releasing roller so that the recording medium is released from the roll; and sag amount detecting means for detecting a sag amount of a sag part of the recording medium, the sag part being formed by placing a tension roller on the recording medium between the releasing roller and the transport roller so that the weight of the tension roller presses the recording medium downward to exert a predetermined tension on the recording medium between the releasing roller and the transport roller, wherein the releasing means adjusts a releasing amount of the recording medium in accordance with the detected sag amount and maintains the position of the tension roller within a predetermined range based on the detected sag amount.

2. The recording apparatus according to claim 1; wherein the sag amount detecting means detects a position of the tension roller based on whether or not light extending from a light emitting part to a light receiving part is interrupted by the sag part.

3. The recording apparatus according to claim 1; wherein the releasing roller has a slip resistant material provided on a circumferential surface thereof.

4. The recording apparatus according to claim 1; further including a motor for rotating the mounted roll to assist the releasing means in pulling the recording medium from the mounted roller.

5. A recording apparatus, comprising:

roll mounting means for rotatably mounting a roll wound with a recording medium;

releasing means, including a releasing roller, for pulling the recording medium from the mounted roll by rotationally driving the releasing roller thereby releasing the recording medium from the roll;

transporting means, including a transport roller, for transporting the released recoding medium in accordance with a recording operation;

recording means for recording on the transported recording medium;

a tension roller disposed on and supported by the recording medium at a location between the releasing roller and the transport roller so that the weight of the tension roller sags the recording medium and exerts a predetermined tension thereon between the releasing roller and the transport roller; and sag amount detecting means for detecting an amount of sag of the recording medium between the releasing roller and the transport roller, wherein the releasing means adjusts the amount of release of the recording medium from the roll in accordance with the detected sag amount.

6. The recording apparatus according to claim 5; wherein the releasing means maintains the vertical position of the tension roller within a predetermined range based on the detected sag amount.

7. The recording apparatus according to claim 5; wherein the sag amount detecting means detects a position of the tension roller based on whether or not light extending from a light emitting part to a light receiving part is interrupted by the sagging recording medium.

8. The recording apparatus according to claim 5; wherein the releasing roller has a slip resistant material provided on a circumferential surface thereof.

9. The recording apparatus according to claim 5; further including a motor for rotating the mounted roll to assist the releasing means in pulling the recording medium from the mounted roller.

* * * * *